US008590216B1

(12) United States Patent
Hurt, III

(10) Patent No.: US 8,590,216 B1
(45) Date of Patent: Nov. 26, 2013

(54) LOCKING COLLAR FOR SPACE FRAME CONSTRUCTION

(76) Inventor: John Morgan Hurt, III, Buffalo Valley, TN (US)

( * ) Notice: Subject to any disclaimer, the term of this patent is extended or adjusted under 35 U.S.C. 154(b) by 1 day.

(21) Appl. No.: 13/530,133

(22) Filed: Jun. 22, 2012

(51) Int. Cl.
*E04B 7/08* (2006.01)

(52) U.S. Cl.
USPC ..... 52/81.3; 52/646; 403/171

(58) Field of Classification Search
USPC ..... 52/80.1, 81.1, 81.2, 81.3, 637, 646, 52/655.1; 403/169, 171, 172, 173, 174, 403/176, 116
See application file for complete search history.

(56) References Cited

U.S. PATENT DOCUMENTS

| | | | | | |
|---|---|---|---|---|---|
| 3,323,820 | A * | 6/1967 | Braccini | 403/218 |
| 3,486,278 | A * | 12/1969 | Woods | 52/81.3 |
| 3,844,664 | A * | 10/1974 | Hogan | 403/171 |
| 4,187,613 | A * | 2/1980 | Ivers et al. | 33/32.1 |
| 4,194,851 | A * | 3/1980 | Littlefield | 403/218 |
| 4,260,276 | A * | 4/1981 | Phillips | 403/172 |
| 4,262,461 | A * | 4/1981 | Johnson et al. | 52/81.3 |
| 4,283,156 | A * | 8/1981 | Harper, Jr. | 403/218 |
| 4,319,853 | A * | 3/1982 | Phillips | 403/172 |
| 4,353,662 | A * | 10/1982 | Du Chateau | 403/171 |
| 4,365,910 | A * | 12/1982 | Ford | 403/172 |
| 4,370,073 | A * | 1/1983 | Ohme | 403/172 |
| 4,379,649 | A * | 4/1983 | Phillips | 403/172 |
| 4,384,801 | A * | 5/1983 | Hamel | 403/172 |
| 4,432,661 | A * | 2/1984 | Phillips et al. | 403/172 |
| 4,484,430 | A * | 11/1984 | Rossman | 52/848 |
| 4,491,437 | A * | 1/1985 | Schwartz | 403/172 |
| 4,534,672 | A * | 8/1985 | Christian, III | 403/172 |
| 4,729,197 | A * | 3/1988 | Miller | 52/81.3 |
| 4,844,649 | A * | 7/1989 | Vandenboom | 403/172 |
| 5,566,516 | A * | 10/1996 | Beaulieu | 52/81.3 |
| 5,957,614 | A * | 9/1999 | Aurich | 403/170 |
| 5,996,288 | A * | 12/1999 | Aiken | 52/81.3 |
| 6,286,283 | B1 * | 9/2001 | Kessler | 52/655.1 |
| 6,321,502 | B1 * | 11/2001 | Castano | 52/653.2 |
| 6,622,447 | B1 * | 9/2003 | Kessler | 52/655.2 |
| 6,701,691 | B1 * | 3/2004 | Niiduma | 52/745.2 |
| 7,434,359 | B2 * | 10/2008 | Geiger | 52/81.3 |
| 7,992,353 | B2 * | 8/2011 | Athan | 52/81.3 |
| 2008/0307720 | A1 * | 12/2008 | Howe | 52/81.3 |

* cited by examiner

*Primary Examiner* — William Gilbert
*Assistant Examiner* — James Ference

(57) ABSTRACT

A locking collar that surrounds a hub of a space frame structure. Struts radiating from the hub pass through openings in the locking collar. The openings each have a size relative to a width of each of the struts that provides a locking action to the struts and limits movement of the struts, which gives support to a shape of the space frame. The locking collar provides support to beams of wood or other materials that are attached to the struts without placing stress on the hub.

13 Claims, 20 Drawing Sheets

LOCKING COLLAR FOR SPACE FRAME CONSTRUCTION

CROSS-REFERENCE TO RELATED APPLICATIONS

The New Zealand Intellectual Property Office has accepted patent application 602216 for Locking Collar for Space Frame Construction as of Dec. 6, 2012, which was advertised in NZ Journal No. 1602, published Dec. 21, 2012. The U.S. patent application Ser. No. 13/530,133 filed Jun. 22, 2012 has been modified to be identical to the NZ patent.

FEDERALLY SPONSORED RESEARCH

Not Applicable

SEQUENCE LISTING OR PROGRAM

Not Applicable

BACKGROUND OF THE INVENTION (1) Field of the Invention

A space frame is lightweight rigid structure constructed from struts in a geometric pattern. The struts in a space frame are connected together by hubs to form interlocking triangles. Some of the first space frames were developed by Alexander Graham Bell in 1900. The first space frame used as a geodesic dome was developed in July 1926 by Walther Bauersfield for the Carl Zeiss Optical Company in Jena, Germany, with the geodesic dome design popularized at a later date by Buckminister Fuller. A space frame is extremely strong for its weight, and is designed to be inherently stable. When a space frame is used as a geodesic dome, its shape approaches a sphere, which allows it to enclose the greatest volume for the least surface area.

The invention described in this patent is of a locking collar that supports the hubs of a space frame, with a geodesic dome being an example of one use for the invention. The large number of hubs in a geodesic dome, and the angles that the struts radiating from these hubs must have relative to the other struts and to the curvature of the dome, is the basis for describing the usefulness of this invention.

The hubs for a geodesic dome must connect the struts together at the proper angles relative to the other struts attached to the hub. Each hub facilitates a 4-way, 5-way, or 6-way connector for the struts in a geodesic dome. The total angle surrounding each hub is 360 degrees, with the number of struts radiating from the hub describing a segment of this angle. Thus, the 5-way hubs must hold the struts at an evenly spaced 72 degree angle relative to the adjoining struts, and the 6-way hubs must hold the struts at an evenly spaced 60 degree angle relative to the adjoining struts. The 4-way hubs are used at the equator of a geodesic dome to provide a rest on the ground as a foundation, and use a 60 degree angle for the struts above the foundation. This invention of a locking collar supports the correct angle of the struts that they must have relative to the other struts.

Geodesic domes come in various frequencies, with the frequencies referenced as 1V, 2V, 3V, etc. The frequency of a dome relates to the number of smaller triangles into which it is subdivided. A high frequency dome has more triangular components, more struts, more hubs, and is more smoothly curved and sphere-like than a low frequency dome.

The frequency of the dome determines the dome curvature angle that the struts will have relative to the radial plane of the hub equator. This angle determines the curvature of the dome structure. A low frequency dome with few struts will have a larger angle of inclination to the radial plane of the hub equator, while a high frequency dome with many struts will have a smaller angle, as this chart demonstrates:

| Frequency | Hubs | Struts | Strut Angle from Radial Plane of Hub Equator |
|---|---|---|---|
| 1 V Dome | 11 | 25 | 32 degrees |
| 2 V Dome | 26 | 65 | 16 to 18 degrees, depending on strut length |
| 3 V ⅜ Dome | 46 | 120 | 10 to 12 degrees, depending on strut length |
| 3 V ⅝ Dome | 61 | 165 | 10 to 12 degrees, depending on strut length |
| 4 V Dome | 91 | 250 | 7 to 9 degrees, depending on strut length |

Enforcing the correct strut angle relative to the radial plane of the hub equator is crucial to maintaining the spherical shape of the geodesic dome. If the hubs are not strong enough to provide the correct dome curvature angles to the struts, the dome will collapse. This invention of a locking collar provides support for each hub and keeps the struts in the correct dome curvature angles they have relative to the radial plane of the hub equator.

The struts for many domes are made from metal or PVC pipes. In the USA, these materials usually come in 3 meter lengths, which is too long for stable dome construction, and so are cut in half to 1.5 meter lengths. A 2V frequency dome with 1.5 meter struts will create a dome with a 2.4 meter radius, which is good for a small tent-like structure, and it only requires 26 hubs. To create a house-sized dome with a radius of 5.8 meters using 1.5 meter struts will require a 4V frequency design, which requires 91 hubs.

What is apparent from this information is the large number of hubs needed to create a dome for housing people or large machinery. For a 4V dome with 91 hubs, if each hub is produced for only $100.00, the cost of hubs alone would be $9,100. The high cost of the hubs defeats the purpose of constructing an inexpensive geodesic dome shelter.

This invention of a locking collar eliminates the need for the geodesic dome hubs to be built of sturdy and expensive materials to handle the angular stress applied against them.

A geodesic dome is a space frame, but space frames can designed in other shapes. One example is a space frame constructed as a "hoop house" for greenhouses, or for barns and other large buildings. This type of space frame design is a geodesic cylinder in shape, with the cylinder divided in half along its axis and laying on its side. Many well-supported hubs are needed for this design, and this invention of a locking collar relieves the stress on the hubs of a space frame in this shape as well.

This invention of a locking collar consists of the addition a simple, inexpensive support to surround each hub of a space frame. This invention relieves the stress on the hubs, which allows much simpler and cheaper hubs to be used.

(2) Description of the Related Art

In prior art, there are many types of hub designs, but they do not include a separate locking collar support system as described in this patent. This invention of a locking collar is not a hub, but a separate support system, and can work in addition to each of various hub designs that have received a United States Patent or are otherwise in use. This invention makes many of these hubs obsolete, as it allows for a simpler and much less expensive type of hub to be used for space frame construction.

BRIEF SUMMARY OF THE INVENTION

This invention is a locking collar that has a plurality of openings. The locking collar surrounds the hub of a space frame, with each of the struts that radiate from the hub passing through an opening in the locking collar. The locking collar reduces the stress against the hub by insuring that the strut and hub connection no longer acts as a fulcrum. The locking collar accomplishes this by locking the strut from excessive movement some distance away from the hub. This action takes the stress away from the hub and moves it to the locking collar, which is itself supported by the surrounding struts, and not the hub. This allows a less sturdy and therefore cheaper hub to be used.

The locking collar can be made from a very short section of large pipe with openings in the locking collar that are greater than the diameter of a plurality of the struts. The plurality of struts passing through the openings in the locking collar holds the locking collar in place, as the locking collar does not have contact with the hub, or need support from a cover plate or other connection to the hub. Rather, the locking collar has to function separate and independent from the hub to allow the hub to flex into various positions relative to the locking collar. The independent movement of the hub inside the locking collar relieves the stress applied to the struts.

The locking collar is not fixed to the struts, but allows the struts to move freely inside the openings up to a desired angle. The movement of the struts through the openings in the locking collar also relieves stress on the struts.

The size of the openings in the locking collar in comparison to the diameter of the struts determines the maximum angle of the struts relative to the radial plane of the hub equator. This restriction in the angular movement of the struts by the locking collar keeps the space frame or geodesic dome in the correct shape.

The locking collar works through the relationship between the opening size in the locking collar and the strut diameter. A locking collar with openings the same size as the strut diameter will hold the strut perpendicular to the surface of the collar, and would lock the struts in this position. A locking collar with openings slightly larger than the diameter of the struts will allow the struts to move several degrees before the locking collar restrains or locks the struts from moving further. The larger the opening size in the locking collar in comparison to the strut diameter, the larger the degree of movement available to the struts. A locking collar with a large opening size that is nearly double the strut diameter may give over 45 degrees of movement to the strut. The key to understanding how the locking collar works is that the opening size in the locking collar is made in the correct proportion to the strut diameter to only allow the struts to move the proper number of degrees necessary to keep the space frame or geodesic dome in the correct shape.

A locking collar is usually made out of a single piece of material. However, a locking collar can be made out of two or more pieces that can be assembled around the struts to act as one piece. This allows the locking collar to be placed around the struts surrounding a hub without disassembling the struts from the hub.

The locking collar's primary function is to control the angles of the struts, without placing stress on the hubs. This allows a much cheaper type of hub to be used, such as a simple ring hub with the end of the struts secured to the ring hub with ropes, wires, or cable ties. Without a locking collar, this type of hub would not work with a space frame such as a geodesic dome, as a simple ring hub secured to the struts with ropes, wires, or cable ties would not be able to maintain the strut angles necessary for supporting the geodesic dome, and the geodesic dome would collapse.

The locking collar provides support to allow beams made out of wood or other materials to be securely fastened in parallel to the struts, without placing stress on the hubs. By securing the end of the beams to the locking collar with screws, nails, or other types of pins, the beams are not able to rotate around the axis of the strut. One of the reasons for the addition of wooden beams to the struts is to allow plywood and other traditional home building materials to be fastened more easily to the space frame structure for the construction of geodesic dome homes.

The locking collar can be created in the shape of a thin ring, a cylinder, or a torus, depending on the needs of the installation. The profile of the locking collar can be in the shape of a multi-sided polygon such as a triangle, a rectangle, a pentagon, a hexagon, or other shapes. The profile of the locking collar can be made in the shape of the letter "D", with one flat side, and one curved side. The "D" profile allows the locking collar to be installed on the equator of the geodesic dome with the flat side of the locking collar resting on the ground as a foundation.

The openings in the locking collar can be made in whatever shape necessary to fit the shape of the cross section of the struts. A locking collar can have openings that are circular, rectangular, or elliptical to match the cross-section of the struts that are being used.

A locking collar can have a bevelled edge. A locking collar can have a portion around the openings of the locking collar embedded in a slot in the struts. These adaptations allow the locking collar and the struts to provide a smooth support surface to the outside of the space frame, so that the locking collar is recessed and will not protrude above the struts against any fabric or other surface placed against the outside of the space frame structure.

A locking collar can have one or more of the struts fixed in the openings of the locking collar. This is useful in the construction of a cylindrical space frame, with the locked struts following the axis of the cylinder, and the remainder of the struts forming the curvature of the cylinder. One use of this arrangement is the construction of structures similar to the "hoop houses" used for greenhouse construction.

DETAILED DESCRIPTION OF THE INVENTION

Figure 1:
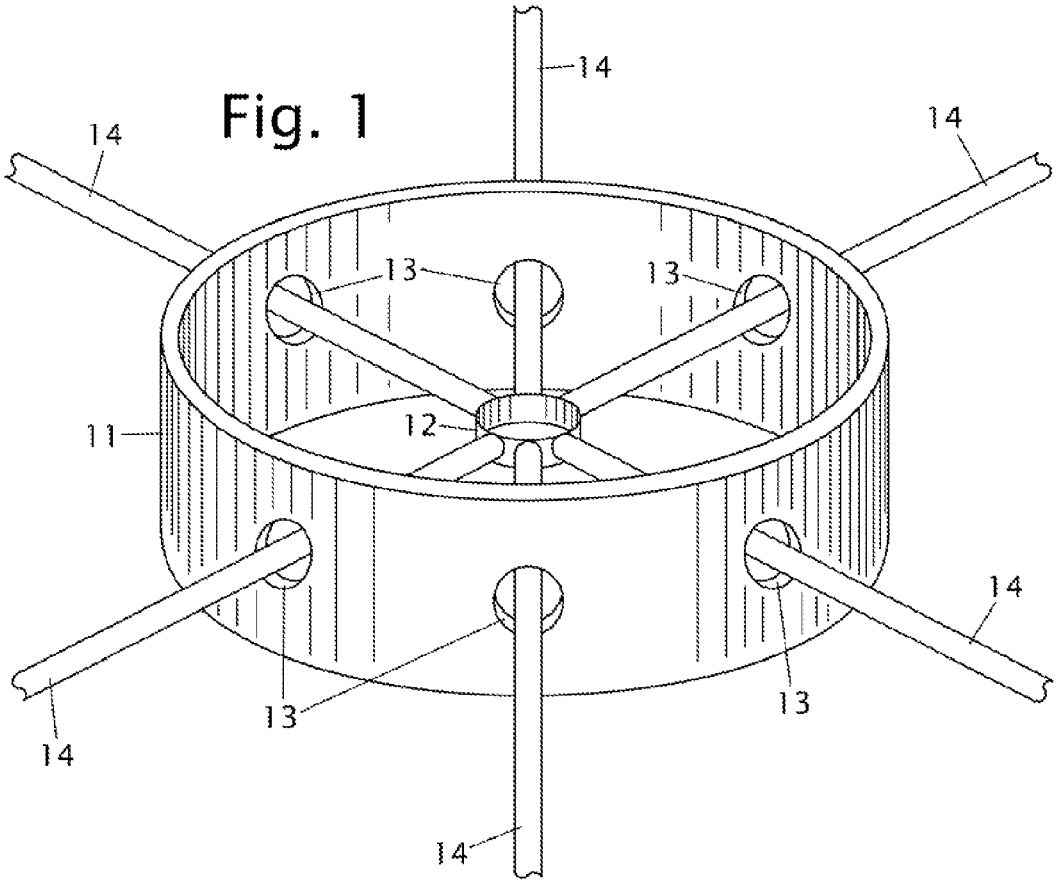
FIG. 1 is a perspective view of a locking collar surrounding the hub of a space frame with the struts that radiate from the hub passing through the openings in the collar.

As illustrated in FIG. 1, the invention is a locking collar 11 that surrounds the hub 12 of a space frame. The locking collar 11 has a plurality of openings 13 with the struts 14 that radiate from the hub 12 passing through each of the openings 13 in the locking collar 11. The locking collar 11 is designed to relieve the hub 12 of angular stress, thereby allowing minimal hubs to be used. The locking collar works through the ratio of the larger diameter of the openings 13 in the locking collar as compared to the smaller diameter of the struts 14 used in the space frame. This ratio prevents the struts from exceeding the correct angle needed to maintain the shape of the space frame. The struts 14 are able to move through the openings 13 to relieve applied stress. The hub 12 can move independently of the locking collar 11 to relieve stress applied to the struts 14, as the hub 12 is not connected to the locking collar 11 through a cover plate or other means. The locking collar 11 is separate and independent of the hub 12 and is supported by a plurality of the struts 14.

Figure 2:
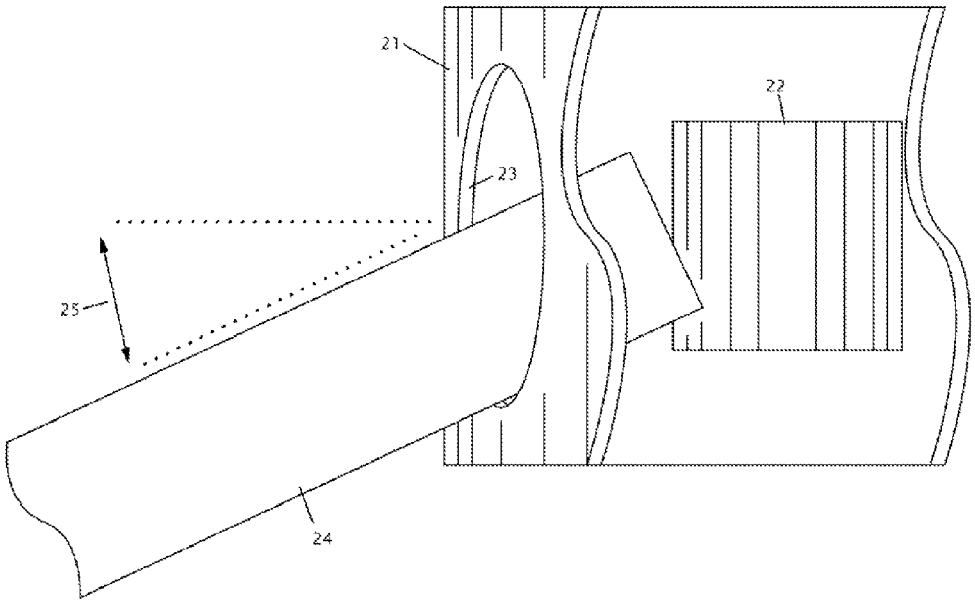
FIG. 2 is a cross-sectional view of how the size of the openings in the locking collar keeps the struts from exceeding a certain angle in comparison to the radial plane of the hub equator.

As illustrated in FIG. 2, the relationship among the thickness of the locking collar 21, the size of the opening 23 in the locking collar 21, and the diameter of the strut 24, limits the angular movement 25 of the strut 24, and transfers the stress applied to the strut 24 away from the hub 22 and to the opening 23 of the locking collar 21. The openings 23 act as a fulcrum for the struts 24, and relieves the stress on the connection between the hub 22 and the strut 24.

Figure 3:
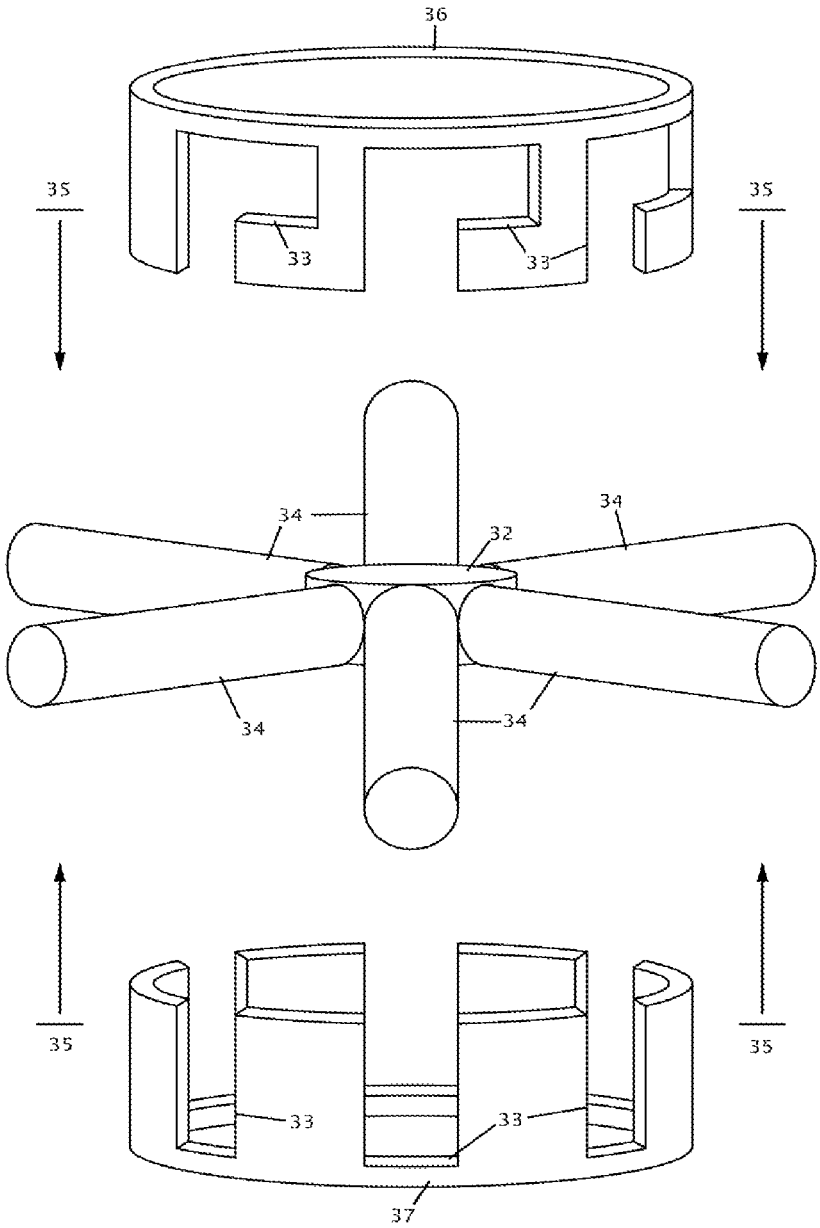
FIG. 3 is an exploded view of how the locking collar can be assembled from two pieces that nest one inside the other, with the openings placed around the struts of a space frame to form a single locking collar to support the hub.

As illustrated in FIG. 3, a single locking collar 35 can be constructed in two pieces by using a second collar 36 that has a different diameter than the first collar 37 and nests inside the first collar when assembled. The openings 33 in the collars are placed over the struts 34 with the two collars surrounding the hub 32 and being secured together to function as a single locking collar. This allows a locking collar to be installed around a hub without removing the struts from the hub.

Figure 4:
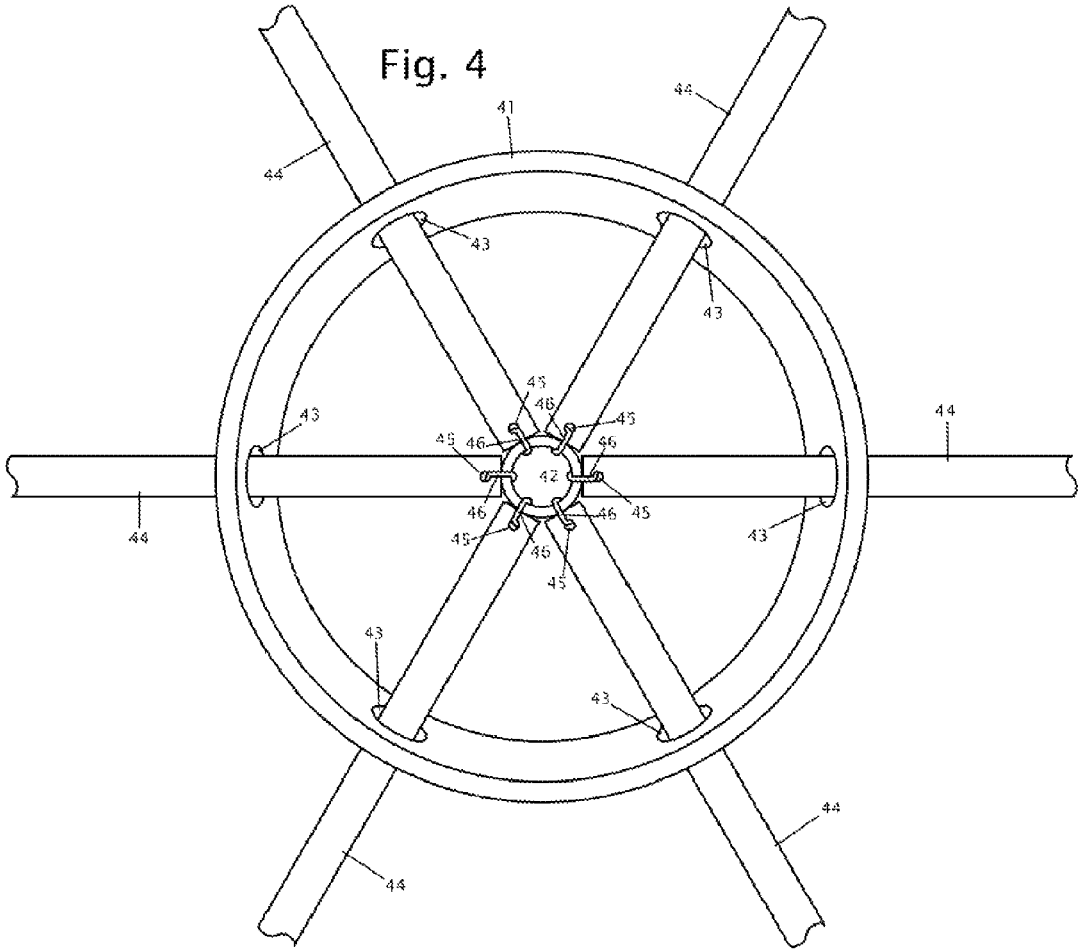
FIG. 4 is a top view of how a very simple hub that would otherwise be unsuitable for space frame construction, which is a ring with the struts attached to it with wire, can be used with a locking collar.

As illustrated in FIG. 4, the locking collar 41 along with the correctly sized openings 43 will hold the struts 44 to the correct angles to allow the use of a very simple hub 42 which is a ring made from a short section of pipe, with wire, rope or cable ties 46 securing the struts 44 to the hub 42 by being tied through openings 45 in the struts and through the hub 42.

Figure 5:
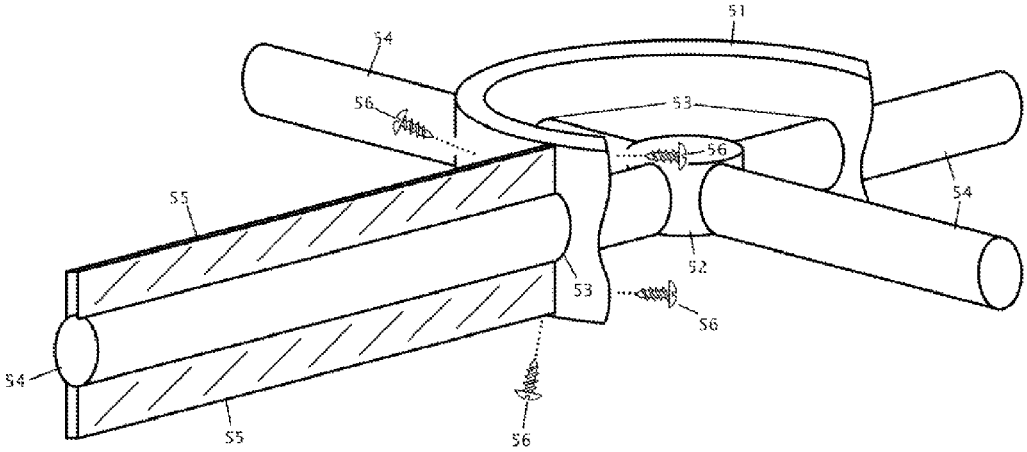
FIG. 5 is a perspective view of how beams of wood or other material can be attached to the struts and secured to the locking collar with screws, nails, or other pins, without placing stress on the hub.

As illustrated in FIG. 5, the locking collar 51 holds the struts 54 that are attached to the hub 52 in the correct position by the size of the openings 53 in the locking collar 51. The locking collar 51 allows beams 55 made out of wood or other materials that are coupled to the strut 54 to be attached to the locking collar 51 using screws 56, nails, or other types of pins. This prevents the beams 55 from rotating around the axis of the strut 54, and prevents any stress from the beams 55 from being placed on the hub 52.

Figure 6:
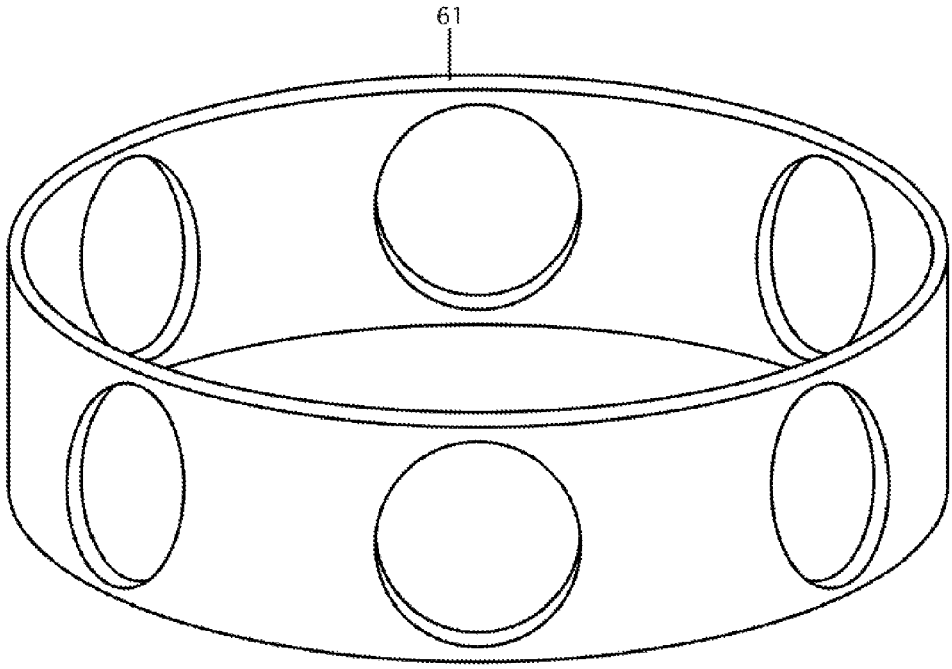
FIG. 6 is a perspective view of a locking collar in the shape of a ring.

As illustrated in FIG. 6, the locking collar can be made in the shape of a ring 61.

Figure 7:
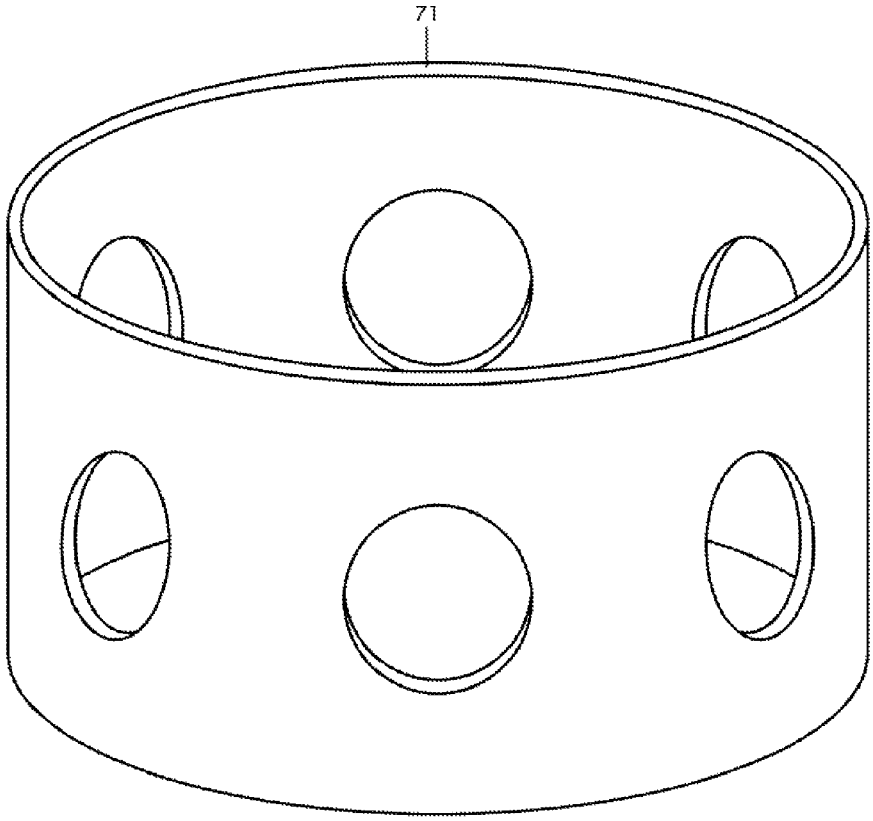
FIG. 7 is a perspective view of a locking collar in the shape of a cylinder.

As illustrated in FIG. 7, the locking collar can be made in the shape of a cylinder 71.

Figure 8:
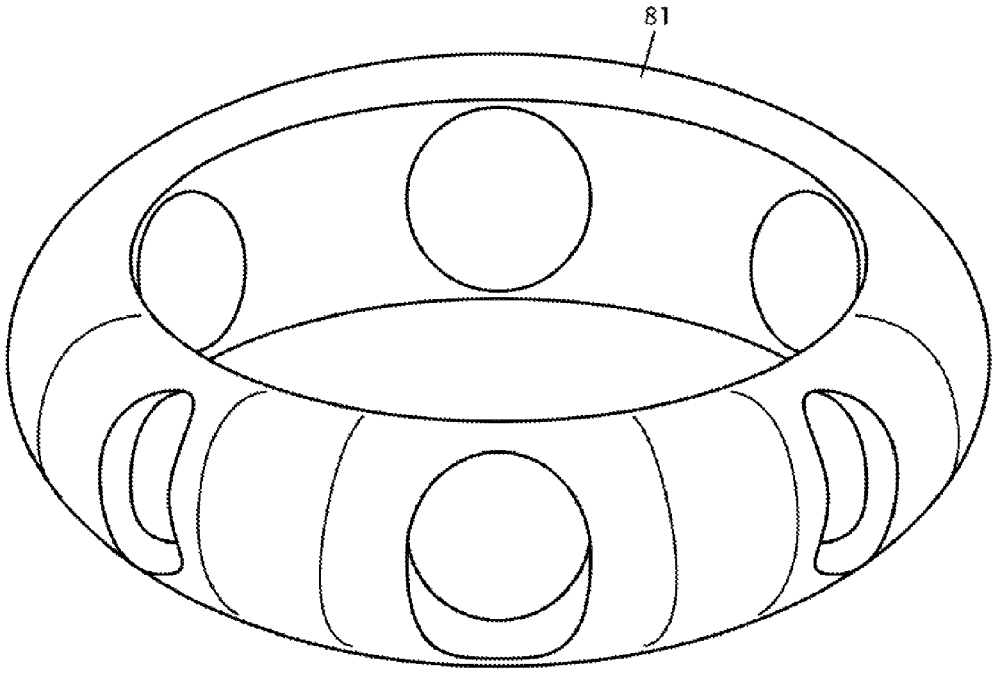
FIG. 8 is a perspective view of a locking collar in the shape of a torus.

As illustrated in FIG. 8, the locking collar can be made in the shape of a torus 81.

Figure 9:
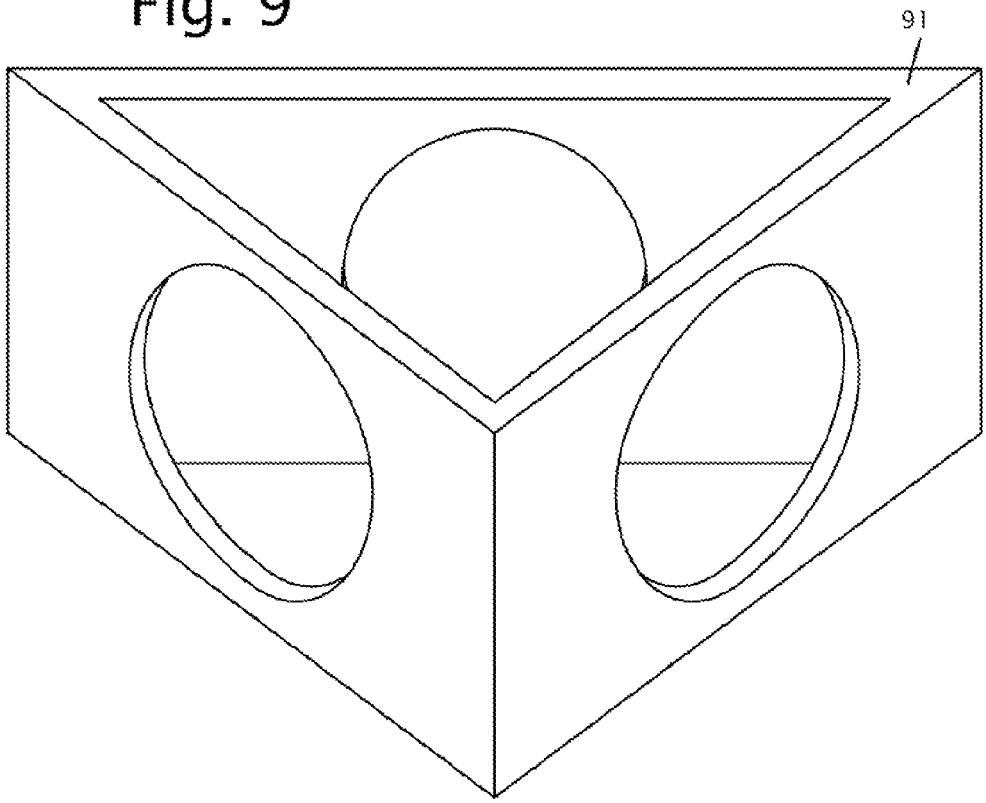
FIG. 9 is a perspective view of a locking collar with a profile in the shape of a polygon, with an example shown of a locking collar in the shape of a triangle.

As illustrated in FIG. 9, the locking collar can have a profile of a polygon, with the example shown of a locking collar with the profile of a triangle 91.

Figure 10:
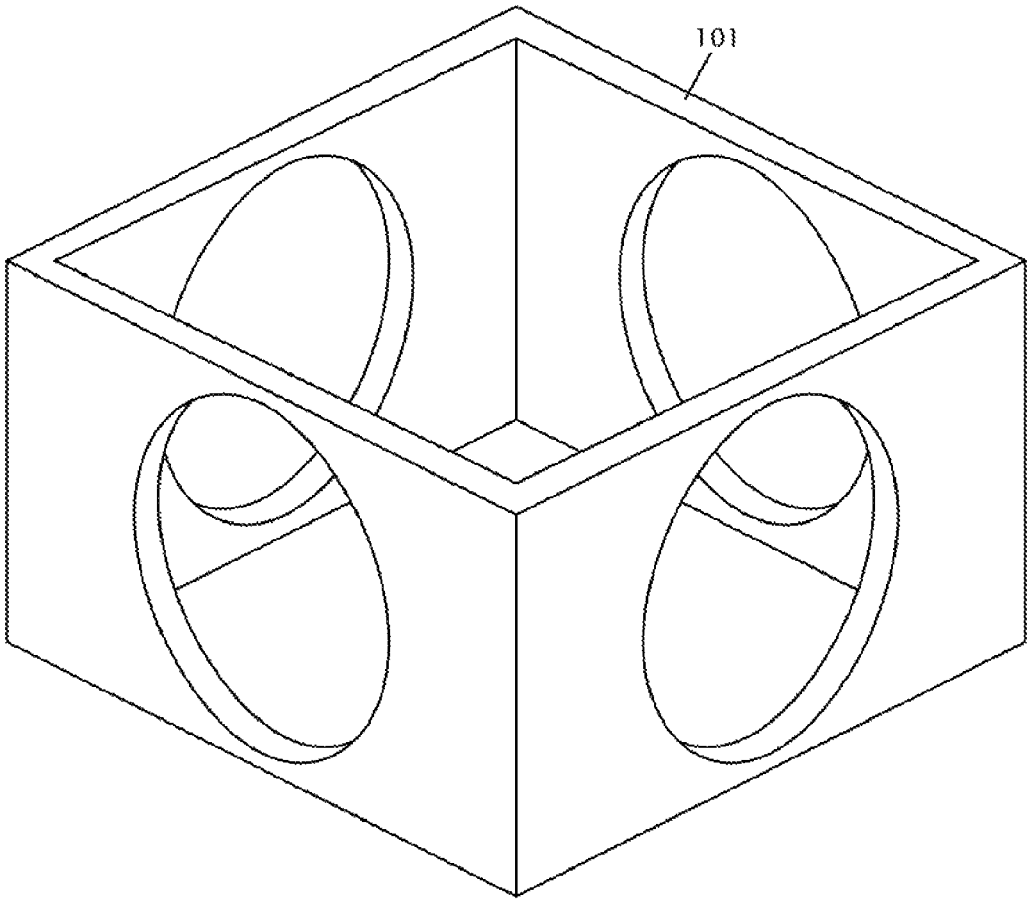
FIG. 10 is a perspective view of a locking collar with a profile in the shape of a polygon, with an example shown of a locking collar in the shape of a rectangle.

As illustrated in FIG. 10, the locking collar can have a profile of a polygon, with the example shown of a locking collar with the profile of a rectangle 101.

Figure 11:
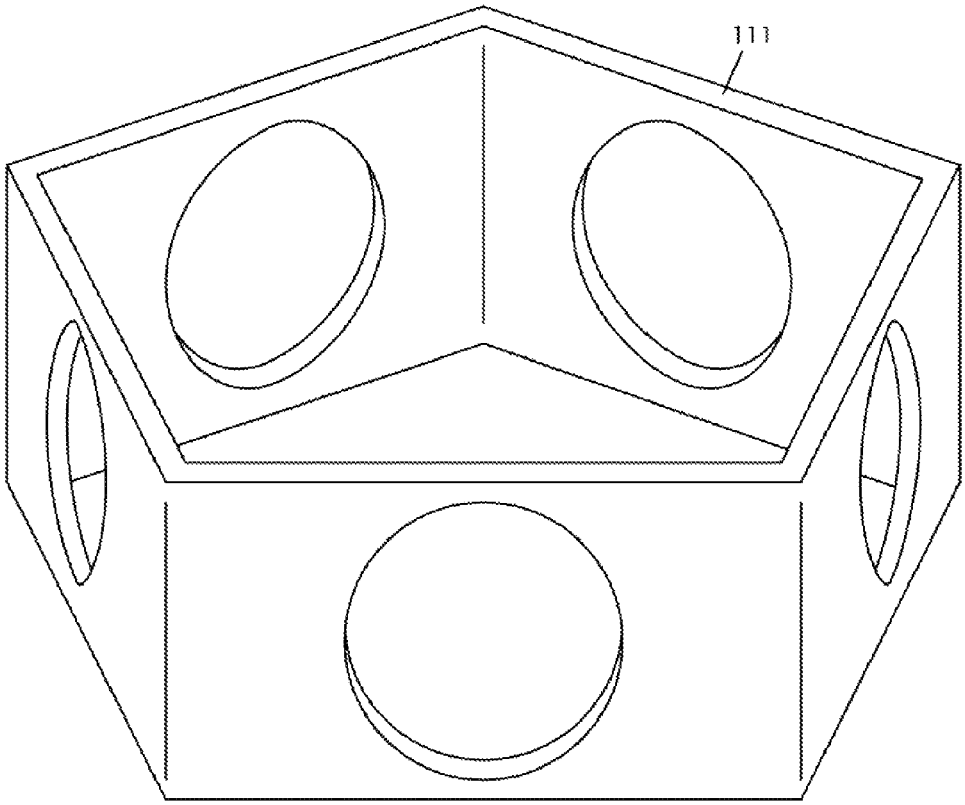
FIG. 11 is a perspective view of a locking collar with a profile in the shape of a polygon, with an example shown of a locking collar in the shape of a pentagon.

As illustrated in FIG. 11, the locking collar can have a profile of a polygon, with the example shown of a locking collar with the profile of a pentagon 111.

Figure 12:
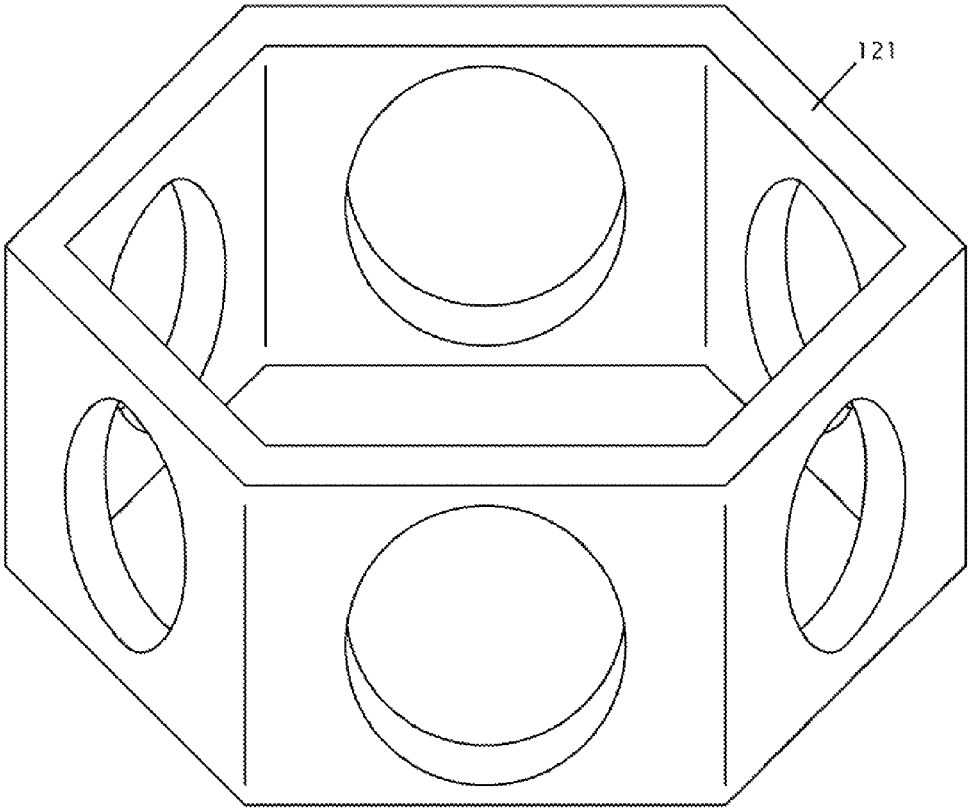
FIG. 12 is a perspective view of a locking collar with a profile in the shape of a polygon, with an example shown of a locking collar in the shape of a hexagon.

As illustrated in FIG. 12, the locking collar can have a profile of a polygon, with the example shown of a locking collar with the profile of a hexagon 121.

Figure 13:
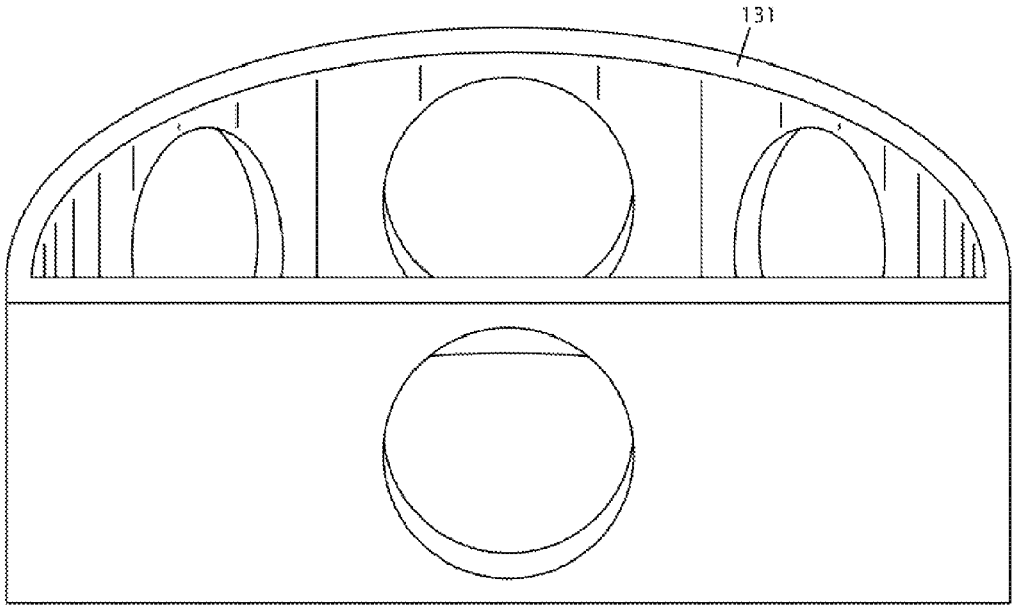
FIG. 13 is a perspective view of a locking collar with a profile in the shape of the letter "D", with one flat side with a straight profile and the rest of the locking collar round with a circular profile.

As illustrated in FIG. 13, a locking collar 131 can have a profile in the shape of the letter "D", with one side flat with a straight profile and the rest of the locking collar round with a circular profile.

Figure 14:
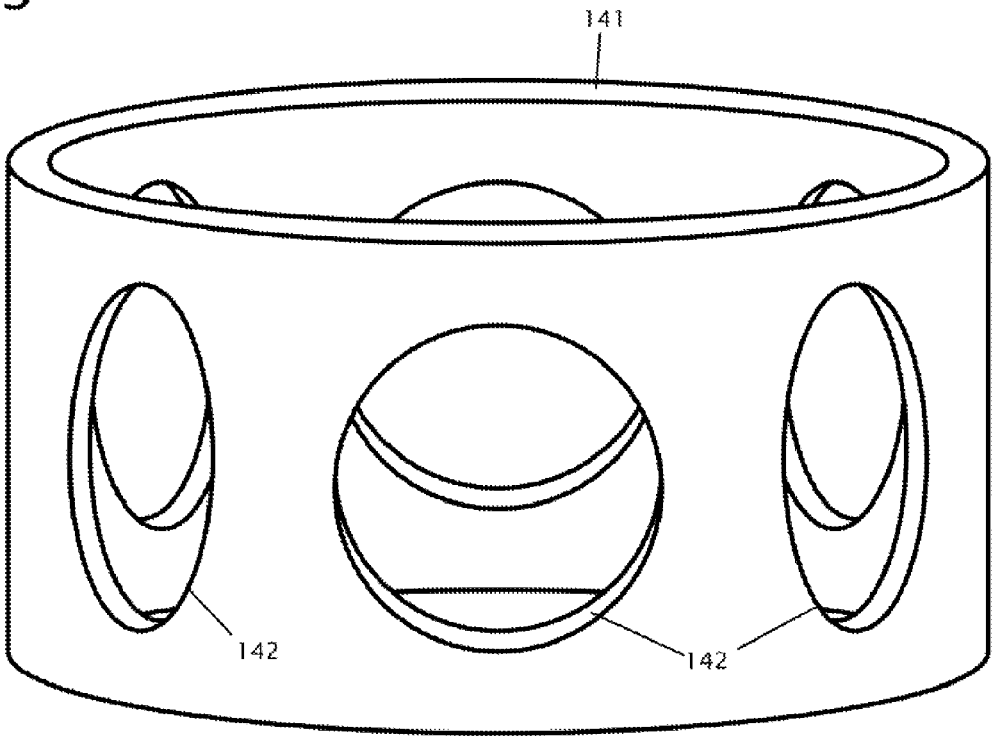
FIG. 14 is a perspective view of a locking collar with the openings in the shape of a circle.

As illustrated in FIG. 14, a locking collar 141 can have openings 142 in the shape of a circle.

Figure 15:
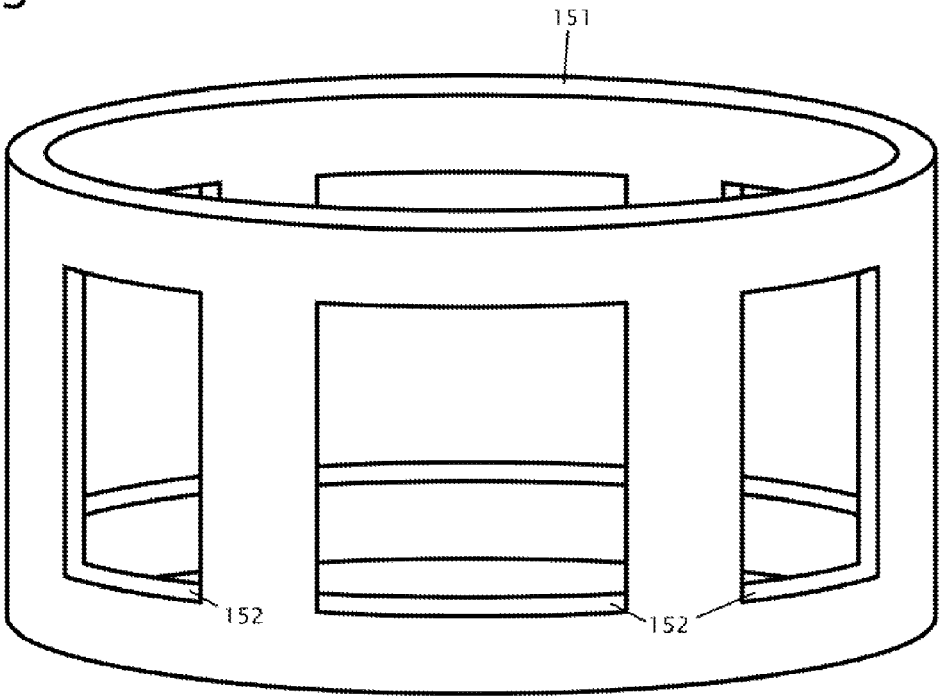
FIG. 15 is a perspective view of a locking collar with the openings in the shape of a rectangle.

As illustrated in FIG. 15, a locking collar 151 can have openings 152 in the shape of a rectangle.

Figure 16:
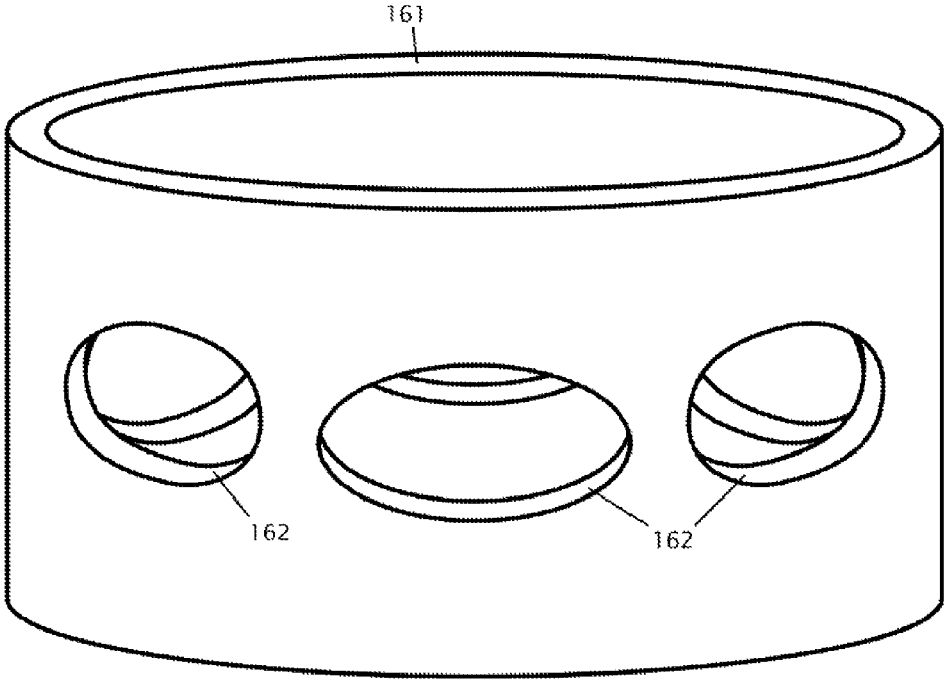
FIG. 16 is a perspective view of a locking collar with the openings in the shape of an ellipse.

As illustrated in FIG. 16, a locking collar 161 can have openings 162 in the shape of an ellipse.

Figure 17:
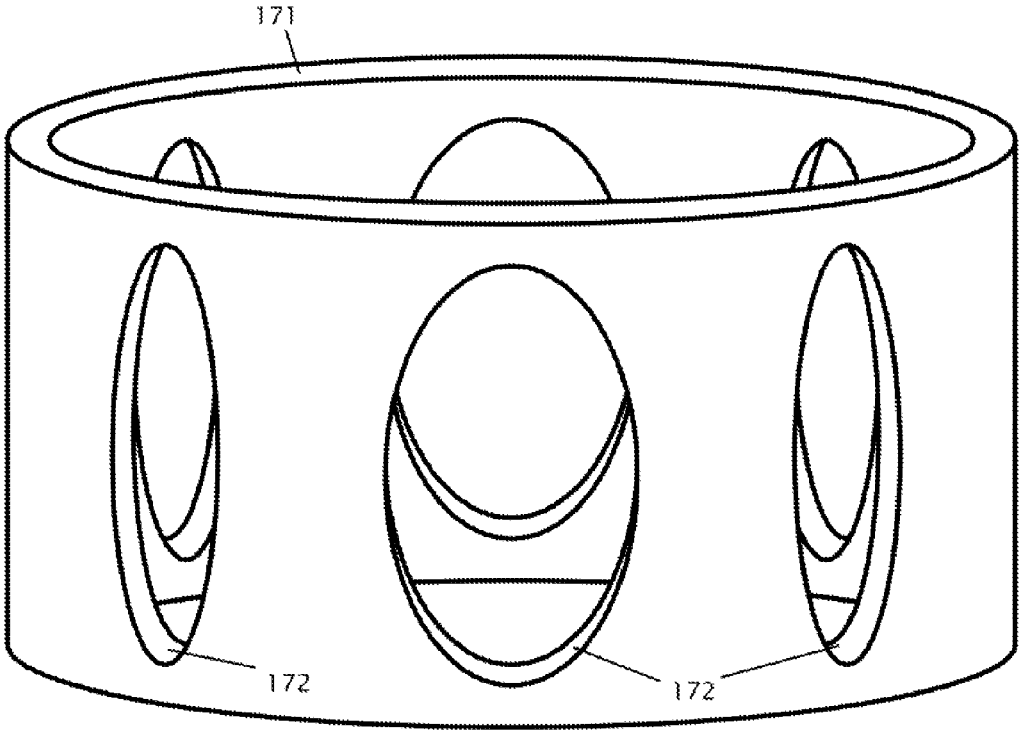
FIG. 17 is a perspective view of a locking collar with the openings in the shape of an ellipse.

As illustrated in FIG. 17, a locking collar 171 can have openings 172 in the shape of an ellipse.

Figure 18:
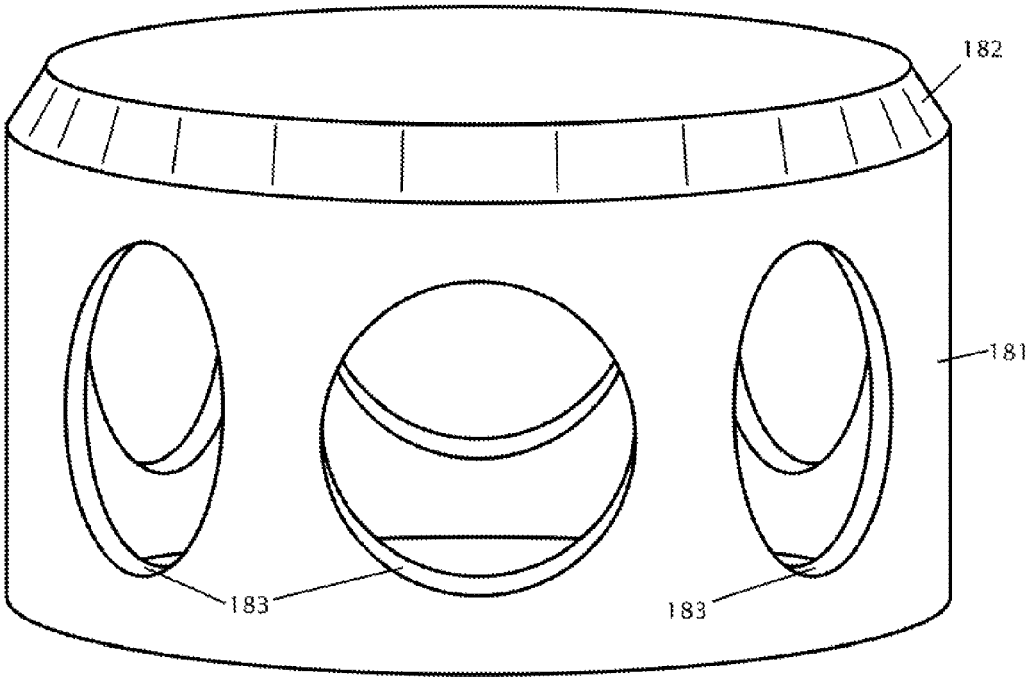
FIG. 18 is a perspective view of a locking collar with the edge of the collar bevelled.

As illustrated in FIG. 18, a locking collar 181 with openings 183 can have an edge 182 that is bevelled.

Figure 19:
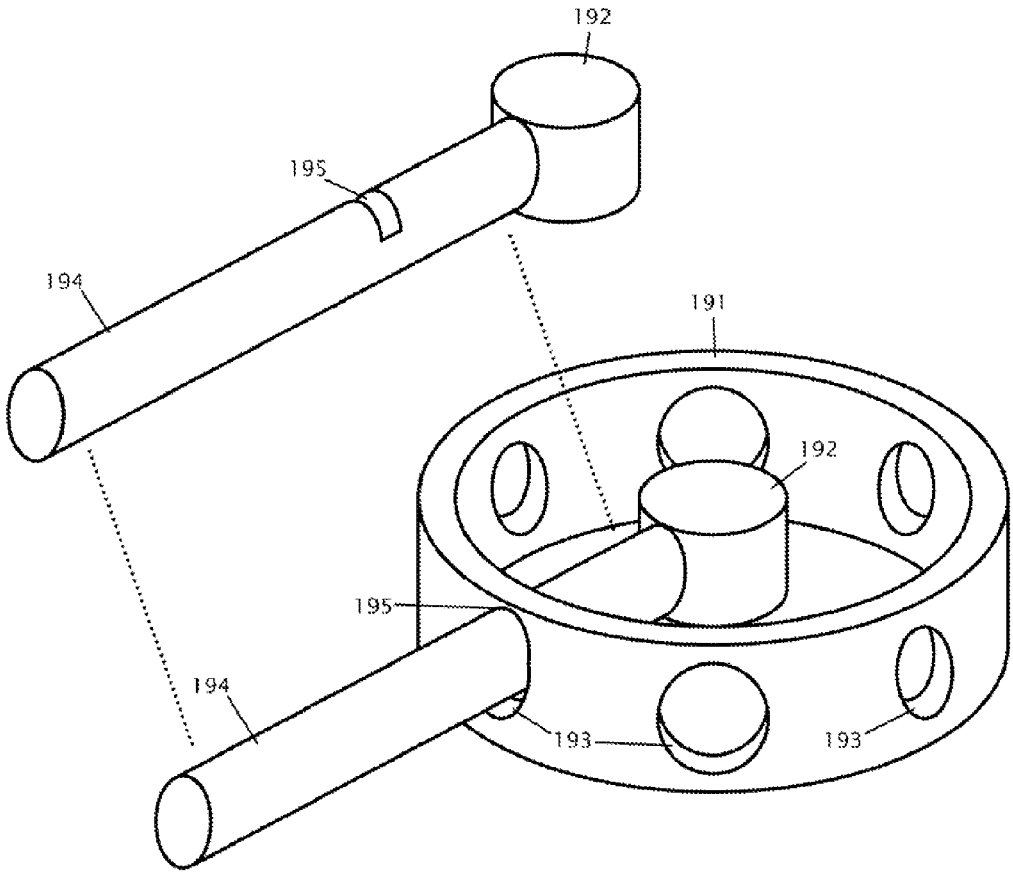
FIG. 19 is an exploded view of a locking collar with a portion of the locking collar embedded in a slot in the strut.

As illustrated in FIG. 19, a locking collar 191 can have struts 194 attached to the hub 192 with a slot 195 in the strut that fits in the opening 193 of the locking collar 191, so that a portion of the locking collar 191 is embedded in the slot 195 in the strut 194.

Figure 20:
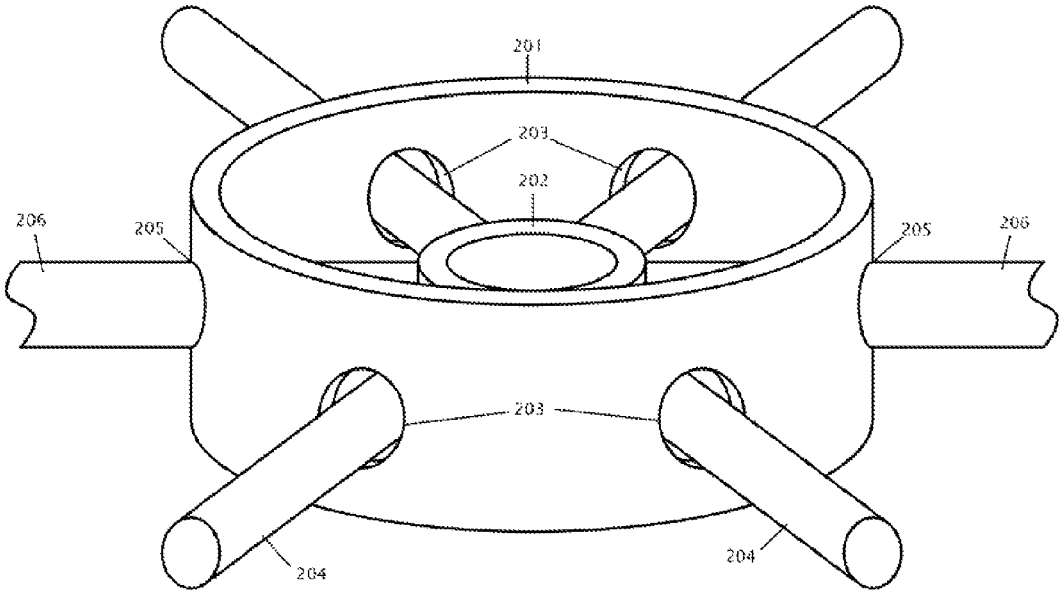
FIG. 20 is a perspective view of a locking collar with one or more of the struts in a fixed position in the opening of the locking collar, while the remainder of the struts are allowed to move to a certain number of degrees in the collar.

As illustrated in FIG. 20, a locking collar 201 and hub 202 can have one or more struts 206 that are fixed to the opening 205 in the locking collar 201 so that they cannot move, while the other struts 204 have larger openings 203 in the locking collar 201 so that they have a greater amount of movement. This arrangement is used for the construction of geodesic cylinders, with the fixed struts parallel to the axis of the cylinder.

The invention claimed is:

1. A device for limiting movement of a plurality of struts that radiate from a hub of a space frame comprising:

a hollow locking collar that surrounds said hub of said space frame;

said locking collar comprises an inner surface facing said hub, an outer surface facing away from said hub, a top edge and a bottom edge;

said locking collar contains a plurality of openings, each of said openings going through said inner and outer surfaces between the top and bottom edges;

each of said struts that radiate from said hub comprises two ends, wherein one of said ends of each of said struts passes through one of said openings in said locking collar to attach to said hub;

each of said openings in said locking collar has a diameter, and each of said struts has a diameter, wherein the diameter of each of said openings in said locking collar is greater than the diameter of each of said struts;

a ratio of the diameter of each of said openings in said locking collar to the diameter of each of said struts limits angular movement of said struts relative to said outer surface of said locking collar to maintain an assembled shape of said space frame;

said locking collar provides leverage for said struts and relieves stress while said struts are connected to the hub;

said locking collar is supported by said plurality of struts, and does not contact said hub;

said locking collar does not require a cover plate or other connection between said locking collar and said hub for said locking collar to connect the struts to said hub;

said hub is capable of moving independently relative to said locking collar;

said hub is capable of moving to different positions within said locking collar to relieve applied stress;

said struts are not fixed to said locking collar; and said struts are attached to said hub through said openings in said locking collar to relieve applied stress.

2. The device as defined in claim 1, wherein said locking collar can be made in two or more pieces that assemble together around said struts.

3. The device as defined in claim 1, wherein said locking collar is a small ring that loosely connects at least one of the ends of said struts with wire, rope, or cable ties.

4. The device as defined in claim 1, wherein said locking collar is attached to beams of wood or other materials that are coupled in parallel to said plurality of struts, wherein said beams are attached to said locking collar with a screw or a pin.

5. The device as defined in claim 1, wherein said locking collar has a shape of a ring, a cylinder, or a torus.

6. The device as defined in claim 1, wherein said locking collar has a profile in a shape of a multi-sided sided polygon.

7. The device as defined in claim 1, wherein said locking collar has a profile in a shape of the letter D.

8. The device as defined in claim 1, wherein the shape of each of the openings in said locking collar is circular.

9. The device as defined in claim 1, wherein the shape of each of the openings in said locking collar is rectangular.

10. The device as defined in claim 1, wherein the shape of each of the openings in said locking collar is elliptical.

11. The device as defined in claim 1, wherein at least one of the top edge and the bottom edge of said locking collar is beveled.

12. The device as defined in claim 1, wherein a portion of said locking collar is embedded in a slot in said plurality of struts.

13. The device as defined in claim 1, wherein one or more of said plurality of struts is fixed in one of said plurality of openings of said locking collar, with additional struts of said plurality of struts capable of moving inside additional openings of said plurality of openings of said locking collar.

* * * * *